US005224417A

United States Patent [19]

Helinski

[11] Patent Number: 5,224,417

[45] Date of Patent: Jul. 6, 1993

[54] INTERPOSER DEVICE AND STRIKER STRIP ASSEMBLY THEREFOR

[75] Inventor: Edward F. Helinski, Johnson City, N.Y.

[73] Assignee: International Business Machines Corporation, Armonk, N.Y.

[21] Appl. No.: 914,970

[22] Filed: Jul. 16, 1992

[51] Int. Cl.[5] ..... B41J 1/20

[52] U.S. Cl. ..... 101/93.14; 400/146

[58] Field of Search ..... 101/93.13, 93.14, 93.31, 101/93.32; 400/144, 146, 248, 642

[56] References Cited

U.S. PATENT DOCUMENTS

| | | | |
|---|---|---|---|
| 4,579,055 | 4/1986 | Thorne | 101/93.14 |
| 4,586,837 | 5/1986 | Johnson et al. | 400/249 |
| 4,780,015 | 10/1988 | Anderson et al. | 101/93.14 |
| 4,967,662 | 11/1990 | Clark et al. | 101/93.14 |

OTHER PUBLICATIONS

IBM Technical Disclosure Bulletin, vol. 33, No. 1A, Jun. 1990, "Impact Line Printer For All-Point Printing".

IBM Technical Disclosure Bulletin, vol. 31 No. 5, Oct. 1988, "Print Hammer Protection And Vibration Reduction on Dot Band Printer".

*Primary Examiner*—Edgar S. Burr
*Assistant Examiner*—Stephen R. Funk
*Attorney, Agent, or Firm*—John S. Gasper; Michael E. Belk

[57] ABSTRACT

An interposer device for an impact band line printer comprises a spring steel interposer plate member with plural chevron flexure elements etched therein so that the apexes thereof are arranged in a row across the plate. A polymer striker strip has a series of cutouts configured in a herringbone pattern and forms a longitudinal spine section with support ribs connecting the spine section to the margins of the strip. Two sided pressure adhesive tapes attached along the margins of the strip are bonded to the surface of the interposer plate with the spine section aligned with but unattached with the apexes of the chevron elements. A laminated interposer strip assembly comprises a polymer striker strip layer with adhesive attachment layers on one side along the margins and a backing layer removably attached to the other side of the striker strip layer.

10 Claims, 2 Drawing Sheets 11
13
14
15
16
17

10
11
12
13
17
18
18a
18b
18c
18d
18e
19
20
21
21a

INTERPOSER DEVICE AND STRIKER STRIP ASSEMBLY THEREFOR

FIELD OF THE INVENTION

This invention relates to printing and more particularly to an interposer device and striker strip assembly usable therewith for condensed printing in an on-the-fly high speed impact line printer.

RELATED APPLICATION

Application of E. F. Helinski, entitled "Printer Apparatus For Printing At Different Print Densities", Ser. No. 07/915,445, filed concurrently herewith.

BACKGROUND OF THE INVENTION

In the related application, an interposer device is disclosed comprising an interposer plate slotted to form flexure elements and a striker strip interposed between the flexure elements and the print hammers to protect the flexure elements against wear due to fretting corrosion. In one embodiment of the interposer device disclosed, the flexure elements are chevron flexure elements disposed symmetrically across the plate. The apexes of the chevron elements are uniformly spaced and arranged in a row substantially co-extensive with a row of print hammers, the row of apexes defining a strike zone when aligned with the print hammers. The striker strip is preferably a thin compliant polymer layer material interposed between the print hammers and the row of apexes and preferably is attached to the side of the interposer plate facing the print hammers with the strip being aligned with but not attached to the apexes of the chevron elements.

Because of its necessarily compliant nature, the striker strip after a period of use develops a certain amount of slack and the edges of the strip tend to curl and form a rollover which can adversely affect the transfer of energy from the print hammers to the flexure elements.

SUMMARY OF THE INVENTION

The subject invention overcomes these problems by providing an interposer device comprising an interposer plate member slotted to form a plurality of flexure elements disposed symmetrically across the plate which are deflectable from the plane of the plate and a striker strip constructed and attached to the plate in manner which prevents the strip from folding over during use. The flexure elements are preferably chevron flexure elements with the apexes thereof arranged in a row across the plate. The invention further provides a striker strip assembly which is easy to handle and can be easily attached to the surface of the interposer plate member in proper alignment with the apexes of the chevron apexes. In accordance with this invention, the striker strip is a thin polymer-like strip made with a series of cutouts which form a longitudinal spine section connected by support ribs to the margins of the strip on either side of the spine section. The cutouts preferably are arranged in a herringbone pattern and the support ribs are slanted at the same angle and in the same direction as the flexible arms of the chevron flexure elements of the interposer plate. The striker strip is attached to the interposer plate by attachment means, preferably adhesive tapes bonded to the margins of the striker strip, with the spine section in overlaying but unattached alignment with the row of apexes of the chevron flexure elements. Such a structure provides a striker strip which is highly compliant, with less slack producing stress and eliminates the problem of rollover. In a second embodiment, the series of cutouts is formed with first and second herringbone patterns to form a longitudinal spine section with two sets of flexible slanted ribs, the sets of ribs being slanted in opposite directions. This arrangement solves the problem of excess stress of the spine section which can be caused by multiple strikes of hammers at different points along the spine section.

The striker strip assembly according to the invention is a laminated strip assembly comprising a thin polymer-like striker strip member layer with cutouts forming a longitudinal spine section with ribs connecting the spine section to margins of the strip member, mounting tape layers adhesively attached to the margins on one side of the striker strip layer and a removable backing layer on the other side of the striker member acts as a stiffener for the striker strip assembly and protection for the striker strip member until the interposer device itself is to be installed into the printer apparatus. The backing layer may be an opaque material and in which case it is made with cutouts in a herringbone pattern aligned with the cutouts of the striker strip layer so that the positioning of the spine section can be visually observed during attachment of the assembly to the interposer plate. The spine and rib construction enables the striker member to be compliant with minimum extraction of impact energy from the print hammers and eliminates foldovers of the strip member. The striker strip assembly is easy to handle and apply to the interposer plate in proper alignment.

The foregoing and other features and advantages of the invention will be readily apparent from the following more particular description of preferred embodiments of the invention as illustrated in the accompanying drawings.

DETAILED DESCRIPTION OF THE INVENTION

Figure 2:
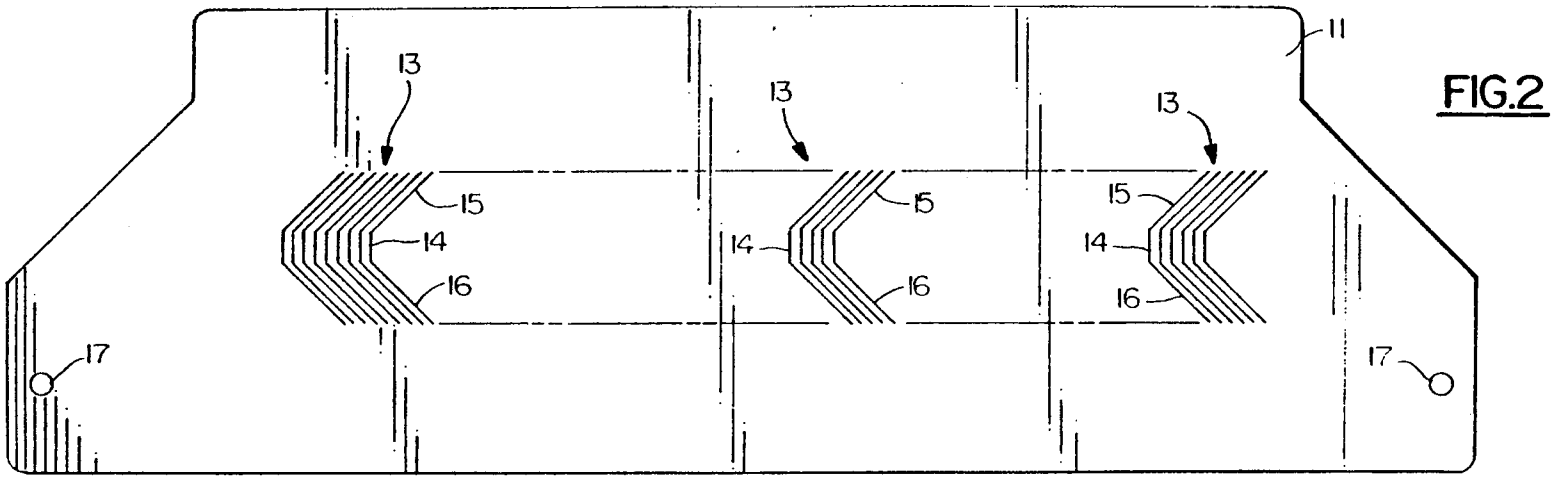
FIG. 2 is a plan view of the interposer plate member of the interposer device of FIG. 1.
Figure 1:
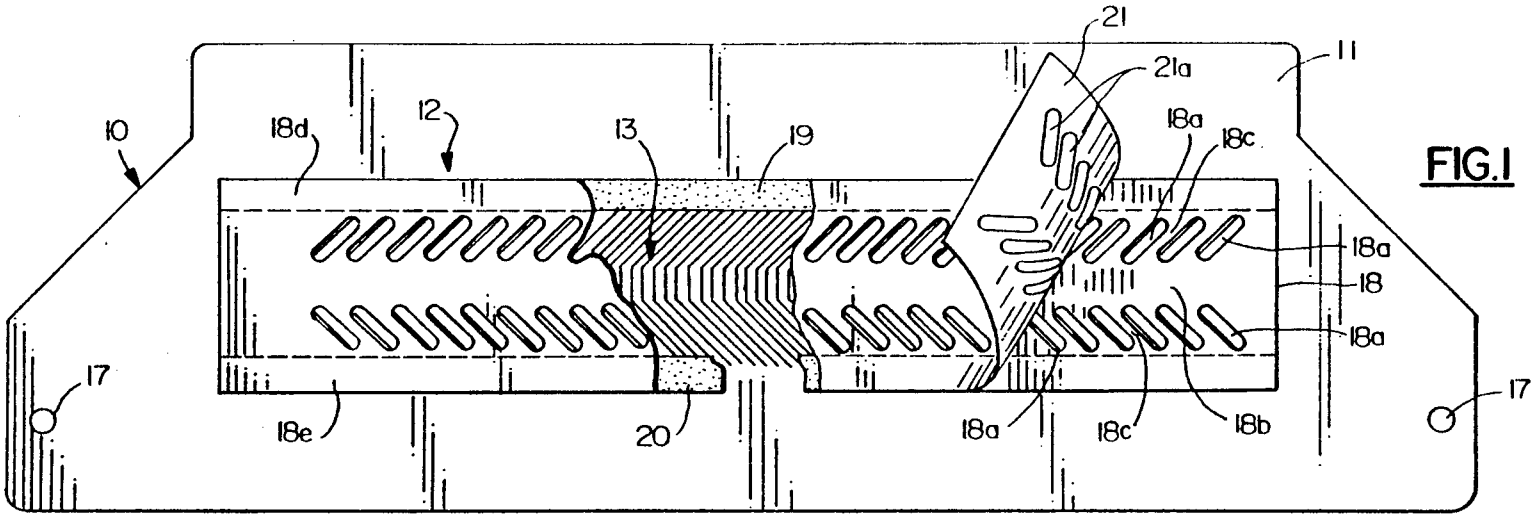
FIG. 1 is a plan view of the interposer device incorporating the features of the invention.

As shown in the FIG. 1, an interposer device 10 in accordance with the invention comprises interposer plate 11 and a portion of a striker strip 12 assembly attached to one side of interposer plate 11. As seen more clearly in FIG. 2, interposer plate 11 has a plurality of chevron flexure elements 13 disposed symmetrically across plate 11. Flexure elements 13 comprise apex sections 14 supported by acutely slanted arms 15 and 16 connected to the plate 11. Apex sections 14 are aligned in a longitudinal row across plate 11 and constitutes the strike zone for print hammers (not shown) of an impact line printer apparatus. Plate 11 preferably is made of metal such as spring or stainless steel and has a thickness in the range of 0.006 to 0.010 inches. Flexure elements 13 are preferably formed by etching slots into plate 11. In this manner, the flexure elements 13 can be made dimensionally very precise and the slots can be kept very small to avoid gaps in printing of characters as discussed in greater detail in the aforementioned related application. Mounting apertures 17 in plate 11 are provided for installing interposer device 10 into an impact band line printer apparatus (not shown).

Figure 4:
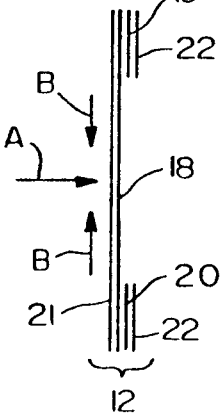
FIG. 4 is a right side view of the striker strip assembly of FIG. 3.
Figure 3:
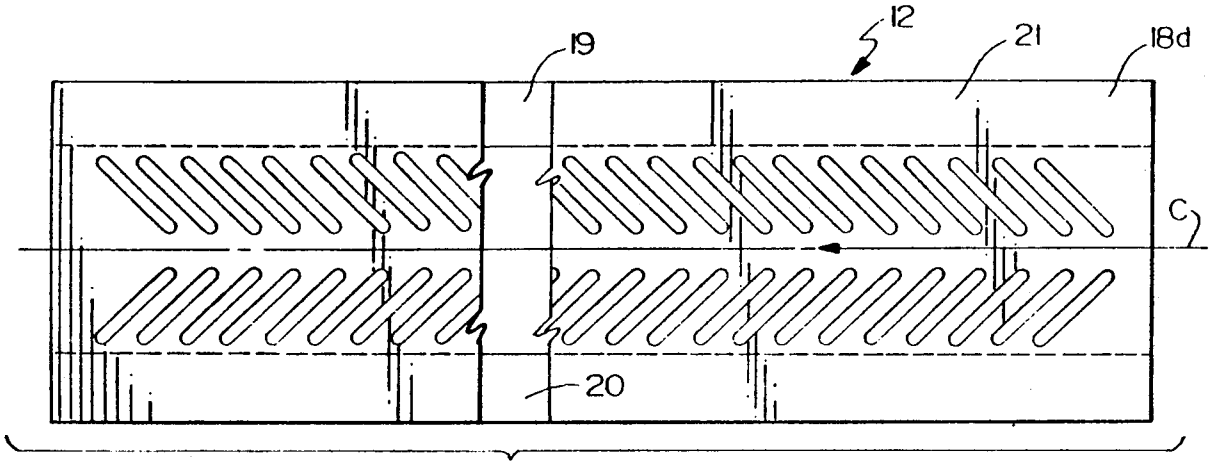
FIG. 3 is a plan view taken of the striker strip assembly for use in the interposer device of FIG. 1.

As seen more clearly in FIGS. 3 and 4, striker strip assembly 12 is a laminated assembly comprising a striker strip layer 18, attachment layers 19 and 20 along the margins on one side of layer 18 and a backing layer 21 on the other side of strip layer 18. Striker strip layer 18 is made with a series of cutouts 18*a* in a herringbone pattern to form a longitudinal spine section 18*b* and support ribs 18*c* which connect spine section 18*b* to margins 18*d* and 18*e* of strip layer 18. Preferably striker strip layer 18 is a transparent polymer material marketed under the tradename FAIRPRENE½ and has a thickness in the range of 0.002 to 0.004 inches. With such material and structure spine section 18*b* is compliant along three axes as indicated by direction arrows A–C. Arrow A indicates the axis of primary motion imparted to the spine section 18*b* by print hammers. Arrow B indicates a second axis of compliance also essential to achieve the primary motion without stretching spine section 18*b*. Arrow C indicates a third axis of compliance required to prevent stretching of the strip member and energy loss. The compliance along the three axes provides minimal restriction of movement of the spine 18*b*. Such compliance is possible due to the flexibility provided by the support ribs 18*c*.

Attachment layers 19 and 20 are two sided pressure sensitive adhesive tapes, one side of the tapes being attached by pressure bonding to the margins 18*d* and 18*e* of striker strip 18. Protective layers 22 cover the other side of attachment layers 19 and 20 and are removable for attachment of the striker strip layer 18 to the surface of interposer plate 11 with the spine section 18*b* in overlaying alignment with the row of apex sections 14 of the chevron flexure elements 13.

Backing layer 21, which can be substantially thicker than the strip layer 18 if desired, provides rigidity and protection to the thin strip layer 18 during handling and bonding to the surface of interposer plate 11. Backing layer 21 is attached to layer 18 by a low strength adhesive which allows layer 21 to be peeled off after strip 18 is bonded to plate 11. A suitable material for backing layer 21 is 3M Brand #9415 Backer Paper or a vinyl film. Such a material may be opaque in which case, backing layer 21 would have cutouts 21*a* coincident with the cutouts in strip layer 18 so that the alignment of the spine section 18*b* with the apexes 14 can be readily observed.

Figure 5:
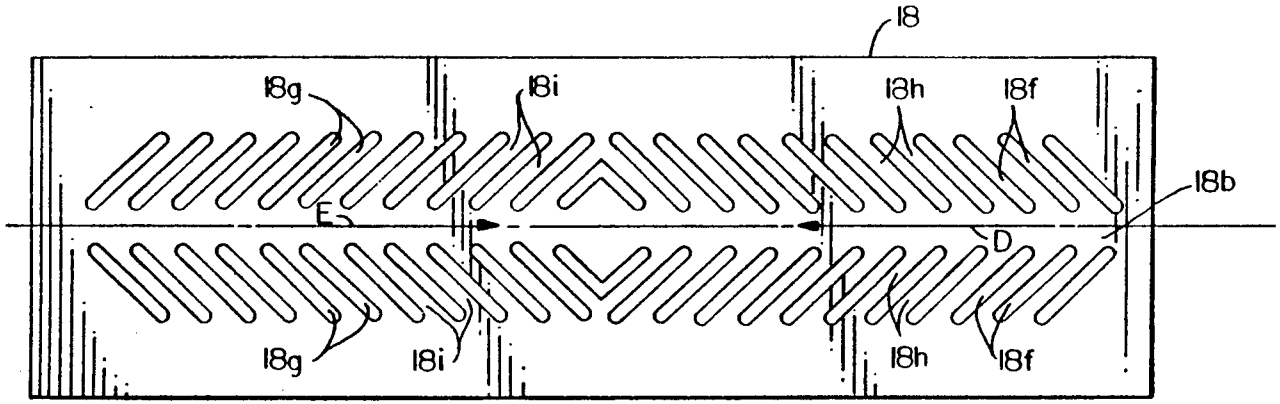
FIG. 5 is a plan view of a second embodiment of a striker strip member usable in the interposer device of FIG. 1.

In the embodiment of FIG. 5, striker strip layer 18 has cutouts 18*f* and 18*g* configured in accordance with two herringbone patterns arranged end to end and each covering one half of the length of spine section 18*b*. In this configuration, spine section 18*b* is connected to margins 18*d* and 18*e* by two sets of support ribs 18*h* and 18*i* each set slanted in opposite directions. This arrangement provides freedom of motion in two directions along the axis of spine section 18*b* as indicated by direction arrows D and E. This arrangement relieves tension stress in spine section 18*b* when impacts occur substantially simultaneously at multiple locations along the length of the spine section.

While the invention has been particularly shown and described with reference to preferred embodiments thereof, it will be understood by those skilled in the art that various changes in form and details may be made therein without departing from the spirit and scope of the invention.

What is claimed is:

1. An interposer device for use in an impact printer comprising in combination
   - a plate member slotted to form a plurality of flexure elements with impact areas disposed symmetrically in a row across said plate, and
   - a striker strip element with a series of cutouts to form a longitudinal spine section and flexible ribs connecting said spine section to margins of said strip element, and
   - attachment means for attaching said margins of said strip element to a surface of said plate member with said spine section in overlaying but unattached alignment with said impact areas of said flexure elements.

2. An interposer device for use in an impact printer in accordance with claim 1 in which
   - said plate member is made of metal wherein said metal is spring or stainless steel, and
   - said striker strip element is made of a compliant material.

3. An interposer device for use in an impact printer in accordance with claim 1 in which
   - said plate member is slotted to form chevron flexure elements disposed symmetrically across said plate,
   - said chevron flexure elements having apexes arranged in a row and connected to slanted flexure arms whereby said apexes of each of said chevron elements may be deflectable out of a plane of said plate, and
   - said series of cutouts being made in said striker strip element in a herringbone pattern to form said spine section, and connected by slanted support ribs connecting said spine section to the margins of said strip element, and
   - said slanted support ribs, when said striker strip element is attached to said surface of said plate member, are slanted in the same direction as said flexure arms of said chevron elements.

4. An interposer device for use in an impact printer in accordance with claim 3 which further includes
   - a cover strip element covering a surface of said striker strip element opposite the surface of said attachment means,
   - said cover strip element having cutouts coinciding with said cutouts of said striker strip element whereby said alignment of said spine section with said row of apexes of said chevron flexure elements can be observed.

5. An interposer device for use with an impact printer in accordance with claim 1 in which
   - said plate member is made from spring steel having a thickness in the range of 0.006 to 0.010 inches, and
   - said striker strip is made from polymer having a thickness in the range of 0.002 to 0.004 inches.

6. An interposer device for use in an impact printer comprising
   - a plate member slotted to form a plurality of chevron flexure elements disposed symmetrically along said plate member,
   - said chevron flexure elements having apexes arranged in a row and supported by slanted flexure arms whereby said apexes elements are deflectable out of a plane defined by said plate member, and a striker strip assembly on one surface of said plate member in overlaying relation with said chevron flexure elements, said striker strip assembly comprising a striker strip layer with a series of cutouts made in a herringbone pattern to form a longitudinal spine section and slanted flexible ribs connecting said spine section to margins of said striker strip layer, attachment tapes having a first surface adhesively attached to a first surface of said striker strip layer along the margins thereof and a second surface adhesively attached to said one surface of said plate member with said spine section of said striker strip layer in overlaying alignment but unattached with said row of apexes of said chevron flexure elements, and a backing layer adhesively attached to a second surface of said striker strip layer opposite said attachment tapes, said backing layer having cutouts made in a herringbone pattern forming a longitudinal cover spine section and slanted ribs in coincident overlaying relation with said spine section and slanted ribs of said striker strip layer, means for removing said backing layer from said striker layer in anticipation of use of said interposer device in an impact printer.

7. An interposer device in accordance with claim 6 in which said slanted flexible ribs in said striker strip layer and said slanted ribs in said backing layer are slanted in the same direction as said slanted flexure arms of said chevron flexure elements.

8. An interposer device in accordance with claim 6 in which said striker strip layer is a transparent polymer layer to enable inspection of the alignment of said longitudinal spine section of said striker strip layer with said row of apexes of said chevron flexure elements, and said backing layer is an opaque polymer layer and said cutouts in said backing layer provide means for observing the alignment and overlay of said spine section with said row of apexes of said chevron flexure elements during attachment of said strip assembly to said plate member.

9. An interposer device in accordance with claim 6 in which said series of cutouts in said striker strip layer is formed in first and second herringbone patterns to make first and second sets of slanted support ribs connecting said longitudinal spine section to the margins of said wear strip layer, and said first and second sets of slanted support ribs are slanted in opposite directions.

10. A laminated striker strip assembly for use in an interposer plate member to form an interposer device usable in an impact printer comprising in combination a striker strip layer having a series of cutouts made to form a longitudinal spine section connected by flexible ribs to margins of said strip layer, attachment layers having a first adhesive surface bonded to a first surface of said striker strip layer along the margins thereof and a second adhesive surface for attachment to said plate member, protector layers removably attached to said second adhesive surface of said attachment layers, and a backing layer removably attached to a second surface of said striker strip layer.

* * * * *